US011013344B2

(12) United States Patent
Mackey

(10) Patent No.: US 11,013,344 B2
(45) Date of Patent: May 25, 2021

(54) MATTRESS AND ADJUSTABLE FOUNDATION SELECTION SYSTEM AND PROCESS

(71) Applicant: NATIONAL BEDDING COMPANY, L.L.C., Hoffman Estates, IL (US)

(72) Inventor: Keith E. Mackey, Janesville, WI (US)

(73) Assignee: NATIONAL BEDDING COMPANY, L.L.C., Hoffman Estates, IL (US)

( * ) Notice: Subject to any disclaimer, the term of this patent is extended or adjusted under 35 U.S.C. 154(b) by 729 days.

(21) Appl. No.: 15/001,539

(22) Filed: Jan. 20, 2016

(65) Prior Publication Data

US 2017/0202366 A1 Jul. 20, 2017

(51) Int. Cl.

| | |
|---|---|
| ***A47C 31/12*** | (2006.01) |
| ***A47C 23/04*** | (2006.01) |
| ***A47C 27/10*** | (2006.01) |
| ***A47C 27/08*** | (2006.01) |
| ***A47C 31/00*** | (2006.01) |

(52) U.S. Cl.

CPC ..... *A47C 31/123* (2013.01); *A47C 23/04* (2013.01); *A47C 27/083* (2013.01); *A47C 27/088* (2013.01); *A47C 27/10* (2013.01); *A47C 31/008* (2013.01)

(58) Field of Classification Search

CPC ..... A47C 31/123; A47C 23/04; A47C 27/088; A47C 27/10; A47C 31/008; A47C 27/083; A47B 2021/0076; A47B 2083/006; A63F 2300/1075

See application file for complete search history.

(56) References Cited

U.S. PATENT DOCUMENTS

| | | | | |
|---|---|---|---|---|
| 4,677,701 | A * | 7/1987 | Galumbeck | A47C 23/0435 5/697 |
| 5,148,706 | A * | 9/1992 | Masuda | A47C 31/123 5/1 |
| 5,844,488 | A * | 12/1998 | Musick | G08B 21/22 340/573.4 |
| 6,468,234 | B1 * | 10/2002 | Van der Loos | A61B 5/01 128/920 |

(Continued)

*Primary Examiner* — David R Hare
*Assistant Examiner* — Alexis Felix Lopez
(74) *Attorney, Agent, or Firm* — Cantor Colburn LLP

(57) ABSTRACT

A mattress and adjustable foundation selection system and process generally includes a mattress having a pressure sensor pad configured to detect localized pressure changes on a sleeping surface as a function of a subject lying on the mattress optionally while the comfort of said mattress is adjusted by means of one or more fluid filled chambers; an adjustable foundation adjustably supporting the mattress and configured to change the mattress from a planar configuration to a non-planar configuration; and a display for displaying a contour map associated with the localized pressure changes. The method includes positioning a subject in a sleeping position on a planar surface of a mattress operatively coupled to an adjustable foundation; displaying to the subject a contour map of localized pressure changes as a function of positioning the subject on the mattress planar surface; adjusting the adjustable foundation and changing the planar surface to a non-planar surface; and displaying to the subject a contour map of the localized pressure changes associated with the mattress non-planar surface.

13 Claims, 3 Drawing Sheets

(56) References Cited

U.S. PATENT DOCUMENTS 6,571,192 B1 * 5/2003 Hinshaw ..... A47C 31/123 702/129
7,467,058 B2 * 12/2008 Boyd ..... A47C 31/123 702/127
8,672,842 B2 * 3/2014 Kenalty ..... A61B 5/0015 324/691
9,830,424 B2 * 11/2017 Dixon ..... G06Q 50/22
2003/0028971 A1 * 2/2003 Chaffee ..... A47C 7/021 5/706
2003/0221261 A1 * 12/2003 Torbet ..... A47C 27/082 5/713
2007/0086947 A1 * 4/2007 Boyd ..... A47C 31/123 424/9.2
2007/0227594 A1 * 10/2007 Chaffee ..... A47C 27/082 137/224
2007/0238935 A1 * 10/2007 Boyd ..... A47C 31/123 600/300
2007/0239370 A1 * 10/2007 Block ..... A47C 23/002 702/41
2008/0093784 A1 * 4/2008 Rawls-Meehan ..... A47C 7/027 267/80
2008/0201856 A1 * 8/2008 Howard ..... A47C 27/001 5/690
2008/0262657 A1 * 10/2008 Howell ..... A47C 20/041 700/275
2009/0006027 A1 * 1/2009 Hinshaw ..... A47C 31/123 702/129
2009/0093990 A1 * 4/2009 McGuire ..... A47C 31/123 702/139
2009/0106905 A1 * 4/2009 Ochi ..... A47C 27/082 5/713
2009/0193587 A1 * 8/2009 Neuenswander .... A47C 20/041 5/618
2009/0314354 A1 * 12/2009 Chaffee ..... G05D 16/208 137/14
2010/0180384 A1 * 7/2010 Balonick ..... A47C 27/082 5/709
2010/0299840 A1 * 12/2010 Brauers ..... A61B 5/1126 5/658
2010/0318239 A1 * 12/2010 Oexman ..... A47C 23/0433 700/301
2011/0138539 A1 * 6/2011 Mahoney ..... A47C 17/80 5/713
2012/0277637 A1 * 11/2012 Vahdatpour ..... A47C 31/123 600/595
2012/0304392 A1 * 12/2012 Khambete ..... A47C 27/001 5/717
2013/0031725 A1 * 2/2013 Riley ..... A47C 27/083 5/713
2013/0104312 A1 * 5/2013 O'Reagan ..... A47C 27/083 5/710
2013/0144751 A1 * 6/2013 Gorjanc ..... G06Q 30/0631 705/26.7
2013/0167301 A1 * 7/2013 Shih ..... A47C 27/081 5/713
2013/0269114 A1 * 10/2013 Wu ..... A47C 27/001 5/716
2013/0269115 A1 * 10/2013 Bader ..... A47C 23/04 5/718
2014/0033440 A1 * 2/2014 Tyree ..... A47C 21/042 5/706
2014/0041127 A1 * 2/2014 Codos ..... A47C 27/083 5/713
2014/0053653 A1 * 2/2014 McCollum ..... B25J 11/00 73/788
2014/0075678 A1 * 3/2014 Murphy ..... A47C 27/056 5/698
2014/0208517 A1 * 7/2014 Gross ..... A47C 27/15 5/691
2015/0000044 A1 * 1/2015 Morimura ..... A47C 27/083 5/710
2015/0241857 A1 * 8/2015 Hille ..... A47C 31/008 700/275
2015/0359351 A1 * 12/2015 Wilder ..... A47C 20/04 5/709
2018/0255941 A1 * 9/2018 Longman ..... A47C 27/18

* cited by examiner

MATTRESS AND ADJUSTABLE FOUNDATION SELECTION SYSTEM AND PROCESS

BACKGROUND

The present disclosure generally relates to a method and system for providing a consumer with a mattress and an adjustable foundation.

Choosing a mattress and adjustable foundation can be a difficult decision for the average consumer. With respect to mattress selection alone, there are many different mattress types and sizes of mattresses to choose from and oftentimes there is very little technical information about the mattresses provided by the retailer or manufacturer so making an intelligent comparison between different mattresses can be overwhelming. With regard to adjustable foundations, most consumers are only aware of adjustments associated with the convenience of watching television or reading a book in an elevated seated position. Most consumers are unaware of the health benefits associated with the use of an adjustable foundation.

Additionally, consumers generally have a challenging time verbalizing to the retail sales associate what they want in a mattress. This inability to verbalize the characteristics of a mattress creates a disconnect between a consumer and a sales associate in the typical retail environment. Often in the retail environment when a consumer walks into a store and asks to see a mattress, the salesperson likely posits the question, "What kind of a mattress are you looking for?" The customer usually then replies, "Firm," "Supportive," "Pillowtop," or "The one that's on sale." This exchange is unproductive. None of the consumer's answers help the salesperson understand how to match a mattress with the consumer's specific needs. Many times a consumer will think they want a "firm mattress." However, after sampling several "firm mattresses" offered by the salesperson and objecting to them because they "feel too hard," consumers eventually come to the realization that what they really need is a medium or plush mattress. Unfortunately, this process of repeatedly sampling mattresses offered by the salesperson tends to frustrate the consumer. More often than not, frustrated with the sales experience, the consumer will leave the store and the purchase of a mattress to another day—less often will the consumer doggedly persist through the sampling process to finally arrive at a mattress that fits his or her needs.

Ultimately, the consumer is looking for a better night's sleep and wants to purchase a quality mattress to improve their chances of achieving this. Further complicating the mattress selection process is the fact that there are two main variables affecting a consumer's purchasing decision, comfort and support. In order to find a quality mattress that meets the consumer's needs, it must have the right combination of both comfort and support. However, whether a quality mattress has the right combination of comfort and support for particular consumer is a very subjective individualized assessment. Currently, this assessment is made through the verbal exchange of the salesperson and consumer, as explained above. And as explained above, defining comfort or support verbally is not an easy task, and one which can easily frustrate the sales process and result in the consumer either leaving the store or choosing a mattress that is not a good fit for him or her. In the latter case, the store must then deal with returns, unhappy customers and/or lost profits.

Compounding the problem is that most consumers test a prospective new mattress while lying on their backs. Most consumers and salespersons ignore that approximately 65% of consumers actually sleep on their side. A mattress that feels good when one is lying on his or her back does not necessarily feel good when one is lying on his or her side. When lying on one's side, one will generate additional surface pressure as his or her weight is dispersed over a smaller area. In addition, when lying on one's side, the profile of the body is more generally pronounced. In other words, in the side lying position, the vertical height difference between the shoulder and the waist is generally greater than the vertical height difference between the lumbar and buttocks in the back lying (supine) position. This difference in weight distribution results in different pressure points for a side sleeper and a back sleeper. Thus, depending upon whether the consumer is predominantly a side sleeper or a back sleeper, the support structure of the mattress may need to be substantially different. Because of differences in a consumer's body profile and pressure points in the predominant sleep position, it is important for a consumer to define comfort and support in terms of his or her predominant sleep position.

BRIEF SUMMARY

Disclosed herein are systems and methods for selecting a mattress and an adjustable foundation. In one embodiment, the system includes a mattress comprising a pressure sensor pad configured to detect localized pressure changes on a sleeping surface as a function of a subject lying on the mattress; an adjustable foundation adjustably supporting the mattress and configured to change the mattress from a planar configuration to a non-planar configuration; and a display for displaying a contour map associated with the localized pressure changes when the mattress is in the planar configuration or the non-planar configuration.

A method includes positioning a subject in a sleeping position on a planar surface of a firmness adjustable mattress operatively coupled to an adjustable foundation; displaying to the subject a contour map of localized pressure changes as a function of positioning the subject on the mattress planar surface; adjusting firmness properties of the firmness adjustable mattress and displaying a contour map of the localized pressure changes associated with each one of the firmness properties; selecting a desired one of the firmness properties; adjusting the adjustable foundation and changing the planar surface to a non-planar surface; displaying to the subject a contour map of the localized pressure changes associated with the mattress non-planar surface; and selecting a mattress having the desired firmness property and the adjustable foundation.

In another embodiment, a method includes positioning a consumer in a sleeping position on a firmness adjustable mattress operatively coupled to an adjustable foundation, wherein the firmness adjustable mattress is at a first firmness level setting and has a planar surface; displaying to the consumer a first contour map of localized pressure changes as a function of positioning the consumer on the firmness adjustable mattress; eliciting feedback from the consumer regarding comfort level associated with the first firmness level setting; changing the firmness adjustable mattress to at least one additional firmness level setting and displaying to the consumer at least one additional contour map of localized pressure changes associated with the at least one additional firmness level setting; eliciting feedback from the consumer regarding the comfort level of the at least one additional firmness level setting, wherein the consumer selects the first firmness level setting or the at least one additional firmness level setting as a most preferred firmness level setting; maintaining the most preferred firmness level setting and adjusting the adjustable foundation to provide the firmness adjustable mattress with a non-planar surface; displaying a contour map of pressure changes associated with the non-planar surface to the consumer; and correlating the most preferred firmness level setting to a non-adjustable mattress having the most preferred firmness level setting; and recommending the non-adjustable mattress to the consumer.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are systems and processes for providing a consumer with a mattress and an adjustable foundation. The systems and processes overcome some of the problems noted in the prior art and provide a consumer with a robust mattress and adjustable foundation selection process based on real time feedback. The real time feedback can include providing the consumer with a readily observable contour map corresponding to pressure points of the consumer while lying on a firmness adjustable mattress in their typically sleeping position, wherein changes in the firmness level to the adjustable bed are selected to mimic different firmness levels associated with the mattresses being offered by the retailer, e.g., plush, firm, extra firm, and the like. Further changes to the adjustable foundation can be utilized to visually demonstrate to the consumer a further reduction in pressure points, i.e., pressure point relief, which may be especially advantageous for those consumers that experience physical issues such as a pinched nerve, chronic back aches, poor circulation, and the like. The contour map provides the consumer with a visual tool that can be used in combination with the tactile sensations experienced by the consumer so as to direct the consumer to mattresses and adjustable foundations having the most desired firmness level and pressure point relief. The retail sales associate (RSA) can then use that information to direct the consumer to a non-adjustable retail mattress and adjustable foundation selection and provide additional information as to the different mattress types that meet the desired firmness specifications, e.g., mattress cores formed of spring coils, foam, fluid filled bladders, and combinations thereof. Optionally, the mattress type may be selected prior to firmness selection.

Figure 1:
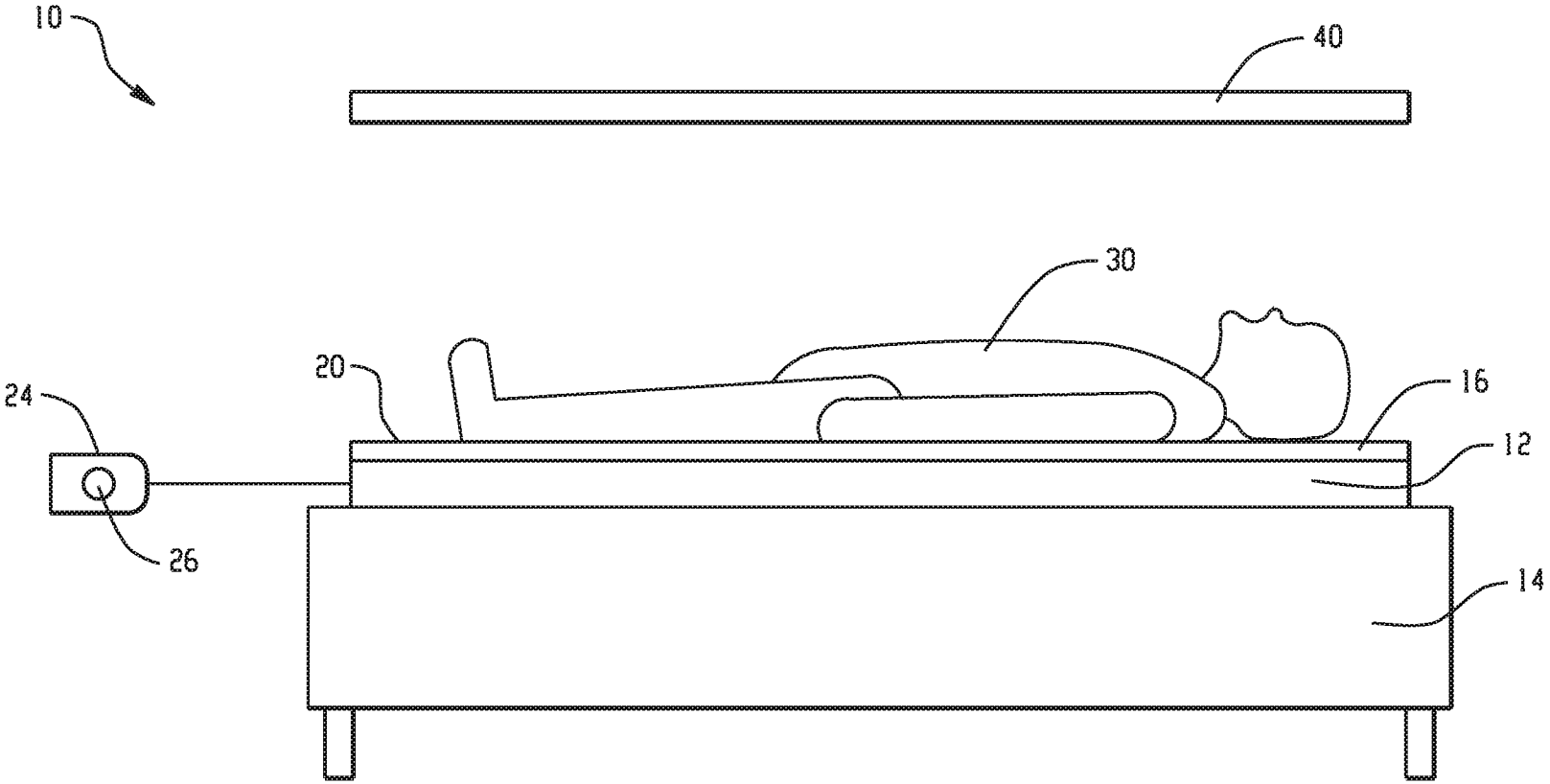
FIG. 1 ("FIG.") schematically illustrates a system for selecting a mattress and adjustable foundation.

Referring to FIG. 1, the system 10 generally employs a firmness adjustable mattress 12 seated on an adjustable foundation 14 and a display 40. The firmness adjustable mattress 12 is configured such that the firmness properties can be adjusted, e.g., soft, plush, firm, extra-firm, ultra-firm, and the like. The firmness adjustable mattress can be a fluidized cell based mattress or some other structure that can be assured of producing standardized support characteristics for the different firmness levels of mattresses associated with the retail store. By way of example, the firmness adjustable mattress may include a mattress core having a plurality of pressure adjustable air bladders. Such an air bed may typically have a plurality of sealed zones with a specified and constant amount of pressure in each that can be varied to mimic the different firmness levels of non-adjustable retail mattresses offered by the mattress retailer. Pressure of the air bed zones is typically at or near twelve inches of water pressure in an unloaded state, which can correspond to a standard setting that is generally representative of a standard firmness mattress being offered by the mattress retailer. Typically, the standard firmness level setting will have a firmness level intermediate the softest mattress and the most firm mattress being offered by the mattress retailer. However, it should be apparent that the initial setting may be at any firmness level, e.g., plush, extra-firm or the like.

The particular firmness adjustable mattress is not intended to be limited so long as firmness is adjustable and generally corresponds to the firmness levels of the non-adjustable mattresses being offered by the retailer. Suitable firmness adjustable mattresses are disclosed in U.S. Pat. No. 7,467,058, which is incorporated herein by reference in its entirety. Likewise, the adjustable foundation is not intended to be limited so long as the mattress seated thereon can be positioned to have a non-planar surface. Suitable adjustable foundations are commercially available under the trade name Renew, from the Simmons Bedding Company, LLC.

Figure 2:
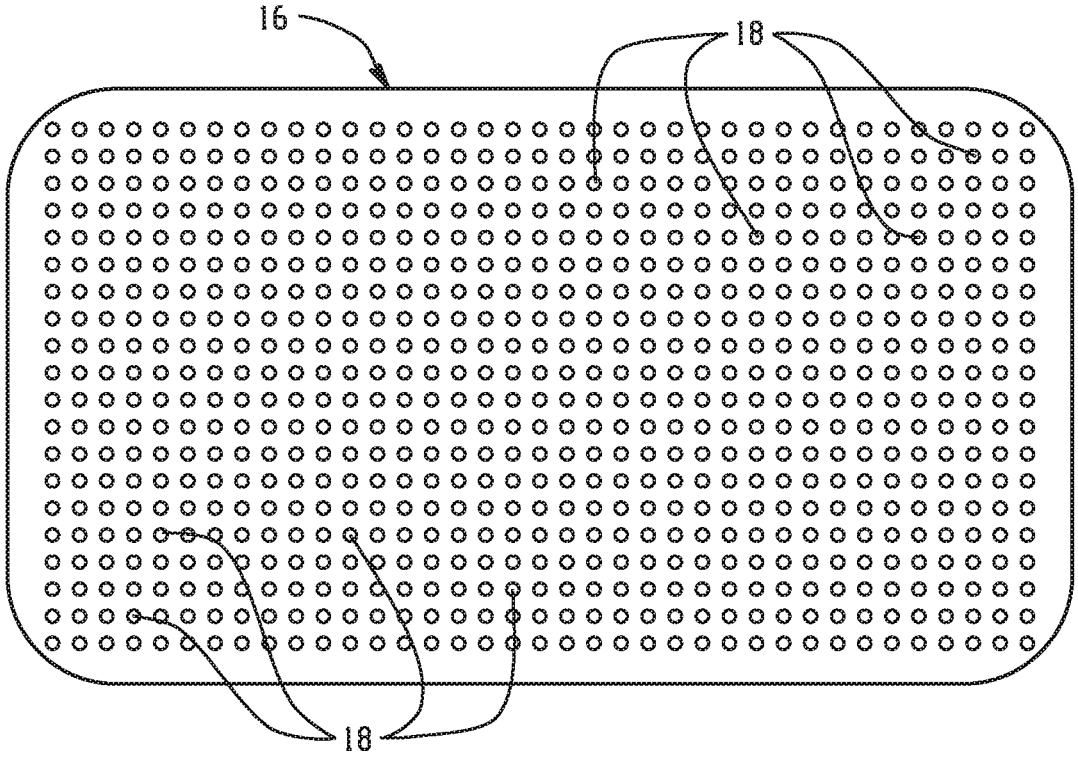
FIG. 2 schematically illustrates a top plan view of a sensor array pad for use in the system in accordance with an embodiment.

The firmness adjustable mattress 12 further includes a pressure sensor array pad 16. The pad 16 includes an array of pressure sensors 18 as shown more clearly in FIG. 2 and may be disposed at the uppermost surface 20 of the mattress as shown (i.e., sleeping surface) or in proximity to the uppermost surface 20 such that the sensors 18 can detect changes in pressure as a function of load on the surface. In one embodiment, the pad 16 including the sensor array 18 is rectangular shaped with individual sensors arranged in a plurality of orthogonal columns and rows as shown in FIG. 2. The sensors 18 are calibrated to each produce a zero output when no person is reclining on the pad, but to each produce an output signal proportional to the pressure exerted on an area of the pad at which the sensor 18 is located. The pressure sensor array pad 16 can have dimensions approximating that of the uppermost surface of the mattress or may approximate the dimensions of a typical prone consumer thereon so that pressure mapping of the consumer in their entirety can occur.

At least one controller 24 is operative with the adjustable mattress 12 to adjust the firmness levels associated with the adjustable mattress. In one embodiment, the controller 24 is a hand held controller with an indicator 26 indicating the relative level of support of the firmness adjustable mattress. Depending upon the type of firmness adjustable mattress 12, the controller 24 can vary. The indicator 26 corresponds to the different levels of firmness associated with the different types of non-adjustable mattresses available by the retailer and controls to adjust the amount of pressure in the firmness adjustable mattress. In one embodiment, the indicator 26 includes five different settings, each setting corresponding to a different firmness level, although more or less settings can be provided.

The same controller 24 or an additional controller (not shown) is operative with the adjustable foundation 14 to adjust the firmness adjustable mattress from a planar configuration to a non-planar configuration, e.g., elevate the head region relative to lumbar and foot regions. Like controller 24, the additional controller 28 may be hand held or optionally may be tethered to the adjustable foundation. The same controller 20 or the additional controller 24 may further include an indicator that is specific to and configured to provide the end user with access to the various functions available with the particular adjustable foundation, e.g., elevation changes of various mattress portions, massage functionality, radio functionality, and the like.

In use, a consumer 30 lies on the uppermost support surface of the firmness adjustable mattress 12. Pressure on each of the individual pressure sensors 18 of the pad 12 is measured and a pressure signal containing a pressure profile array data is generated. Optionally, pressure sensors (not shown) in the zones of the airbed support 12 may also generate signals of support pressure data of each of the airbed zones. The pressure signals are relayed to a computer or other processor, which records the digital information of the pressure profile of the consumer 30 lying on the support surface and converts the pressure signals to a contour map that is displayed on the display 40. In one embodiment, the display 40 is located above the firmness adjustable mattress and adjustable foundation as shown so as to provide the consumer with immediate feedback as it relates to the pressure profile associated with the set firmness level. In other embodiments, the display 40 is located to the side of the adjustable mattress and adjustable foundation at a location accessible to the consumer so that the contour map can be readily viewed if the consumer is laying on his/her side.

The display 40 can have length and width dimensions that approximate the length and width for the support surface for the firmness adjustable mattress so as to provide the consumer with a 1:1 scale. In other embodiments, the display 40 has length and width dimensions that are less than the length and width dimensions of the support surface for the adjustable mattress. In one embodiment, the scale is 1:1 for the display located overhead.

The pressure sensor pad 16, along with the sensors 18 and the software or algorithm for generating a contour pressure profile map are commercially available from Vista Medical of 120 Maryland Street, Winnipeg Manitoba, Canada. The Vista Medical Force Sensing Array: Pressure Mapping System is described by its manufacturer as a clinical tool used to assess pressure distribution and positioning. The information from the force sensing array pad or mat is displayed as a contour plot of different colors on an overhead display having length and width dimensions approximating the length and width dimensions of the adjustable mattress. Thus, when a subject lies in a typical sleep position, e.g., back, side stomach, and the like, the overhead display 40 illustrates a contour map of pressure points indicative of the subject's position on the adjustable mattress, which is readily visible to the end user.

The process for selecting a mattress and/or adjustable foundation generally includes providing a real time image of the pressure contour map to the subject via the display; adjusting the firmness properties of the firmness adjustable mattress to provide a different pressure contour map to the consumer corresponding to the new firmness setting, wherein the firmness adjustable mattress is ultimately adjusted to provide a firmness level desired by the consumer along with a contoured pressure map image associated with the desired mattress firmness. Based on the firmness properties associated with the desired mattress, the RSA refers the subject to various mattresses that approximate the desired mattress. For example, the various mattresses may be selected from air mattress, foam mattresses, coil mattresses, hybrid mattress of air, foam, and/or coils, and the like. Once the desired firmness of the mattress is selected, the RSA adjusts the adjustable foundation to demonstrate to the subject the additional pressure relief provided by the adjustable foundation, which can help alleviate any physical issues the subject may have previously experienced.

Figure 3:
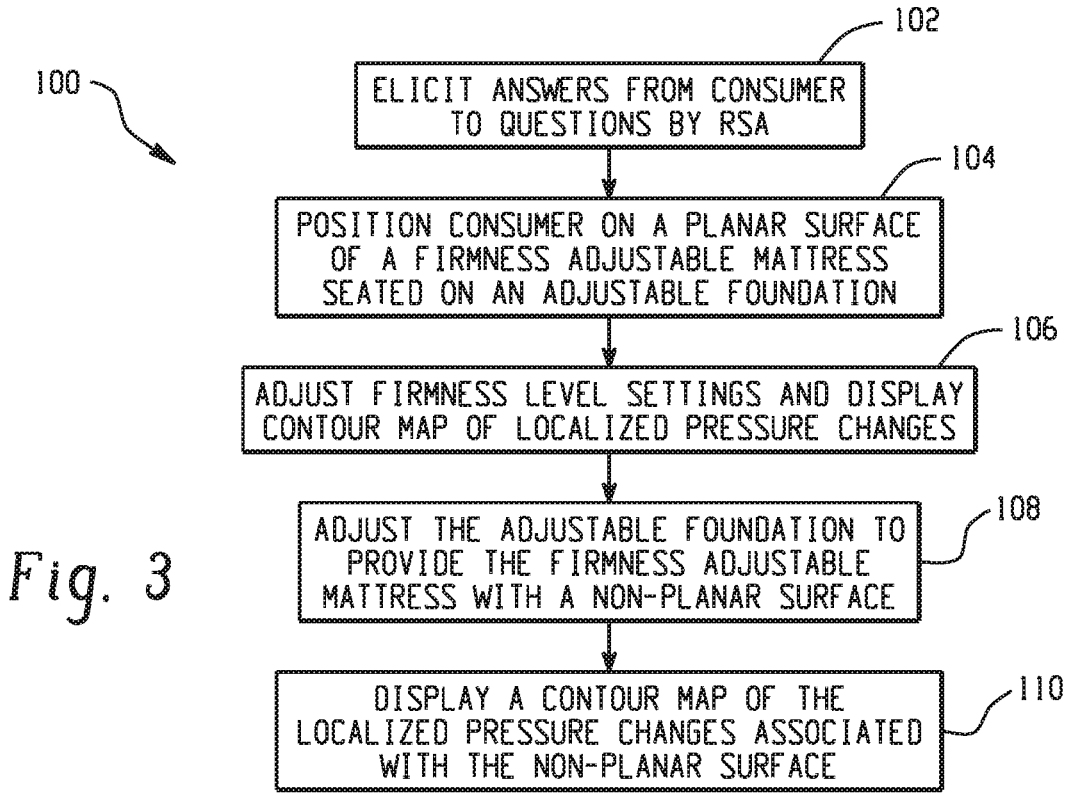
FIG. 3 schematically illustrates a process sequence for selecting a mattress and adjustable foundation.

Referring now to FIG. 3, there is depicted a process sequence 100 for selecting a mattress and adjustable foundation. The process 100 begins upon the consumer entering the mattress retail store, whereupon the consumer is greeted by a RSA. Once it's determined that consumer is interested in purchasing a mattress, the RSA then introduces the consumer to the mattress and adjustable foundation selection system 10. As shown in process step 102, the RSA initially asks the consumer for initial information in the form of questions including name; sleeping position, e.g., back, side, stomach, etc.; whether the consumer is typically too hot, too cold, etc; whether the individual tosses and turns and/or has a difficult time getting comfortable; whether the person snores; whether there are any physical issues, e.g., sleep apnea, acid reflux, circulatory problems, and the like; how the consumer feels after sleeping for an extended prior of time, e.g., whether the consumer experiences any back or neck ache, numbness, is groggy, is alert and ready to start the day; and the like. The data elicited from these questions can be input in a computer, tablet or the like or may be handwritten. The RSA may then confirm the answers.

Based on sleeping preference indicated by the consumer, e.g., back, side, stomach, and the like, a pillow is provided that has been optimized for the particular sleep preference.

Figure 4:
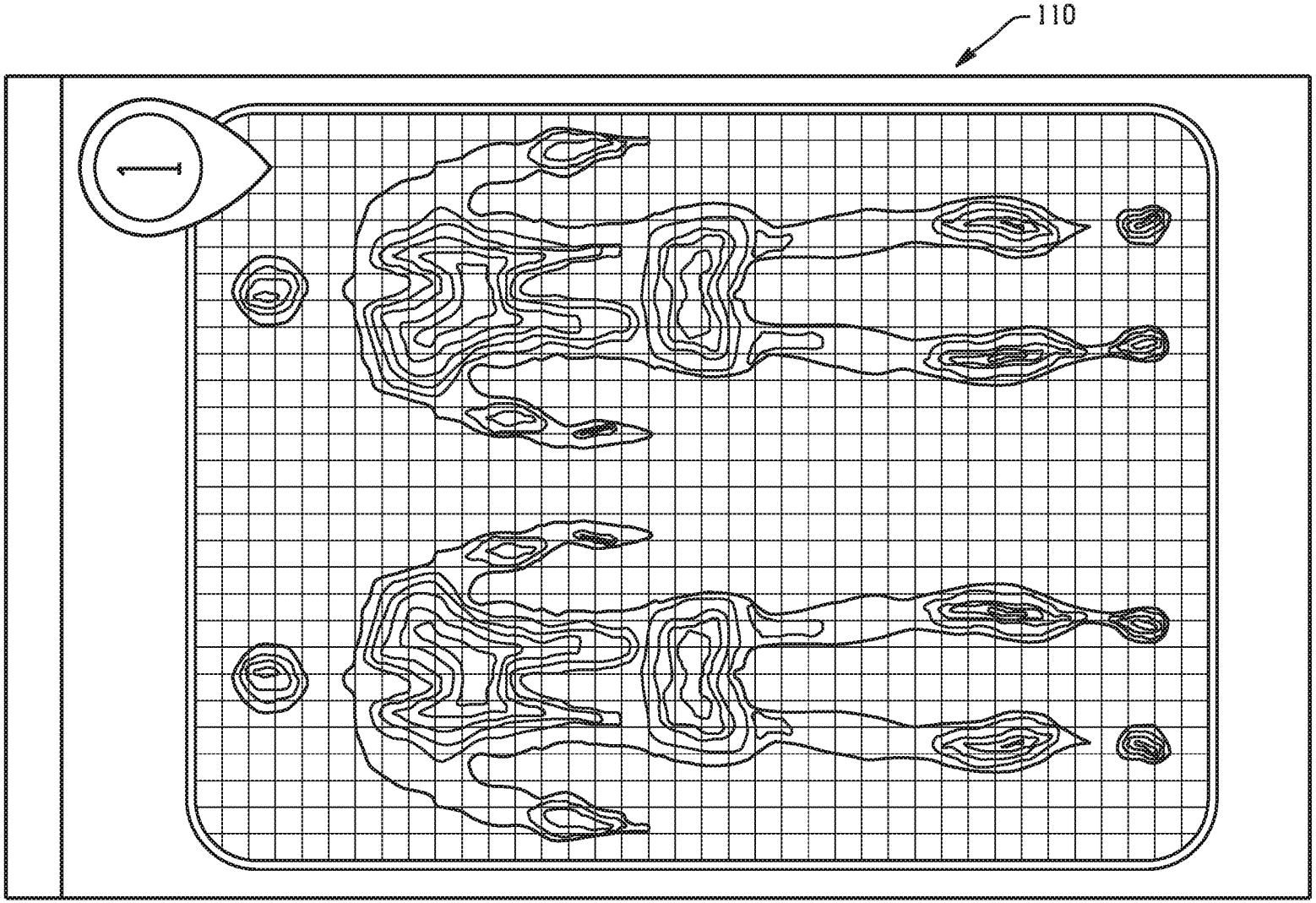
FIG. 4 schematically illustrates an exemplary contour plot of localized pressure changes of a consumer lying on a mattress in accordance with an embodiment.

In process step 104, the RSA asks the consumer to lie prone on the adjustable mattress as he/she would normally when going to sleep. The pressure sensor pad 18 of the adjustable mattress 12 provides a pressure contour map on the display 40, which includes pressure point and support evaluation for the set firmness level. The display 40 is readily visible to the consumer and provides instant feedback as it relates to pressure points as a function of firmness level. FIG. 4 depicts a representative contour map 110, which provides the consumer with a real time view of the pressure distribution of his/her body at the particular firmness level. The RSA then asks the consumer for the comfort level experience associated with the set firmness level.

In step 106, the RSA adjusts the firmness adjustable mattress to a different firmness setting associated with a different family of mattresses that fall within a similar firmness rating. The real-time pressure contour map associated with the new firmness level is generated and displayed to the consumer. The RSA again asks for the comfort level experience from the consumer for the new firmness setting. Specifically, the RSA may ask the consumer as to whether the new firmness setting is better or worse than the prior firmness level, e.g., is it too soft or too firm.

Depending on the answer, in step 108, the RSA may return to the original firmness setting or adjust the firmness adjustable mattress to a different firmness level, e.g., further decrease pressure to make the adjustable mattress softer or increase the pressure to make the firmness adjustable mattress more firm. While the firmness level is being adjusted, the contour map of the pressure is continually being shown to the consumer so that the consumer can visually discern the effect the firmness setting has on pressure points.

The process is repeated until the consumer indicates the most preferred firmness level setting. The system and process advantageously provide a compromise between comfort, pressure point relief, and contour support based on the consumer's tactile experience and visualized pressure contour map.

From this, the RSA can refer the consumer to non-adjustable mattresses offered by the retail store that have a similar firmness level albeit may be of different mattress types, different budgets, and the like. In one embodiment, there are five firmness settings, wherein each firmness setting mimics firmness properties associated with a family of mattresses. Although reference is to five different firmness settings, more or less firmness settings can be used. By way of example, firmness levels may categorized as follows: 1=extra plush, 2=plush, 3=plush-firm, 4=firm, and 5=extra firm. In the event the consumer chooses plush as the desired firmness level based on tactile sensation and as visual representation provided by the contour map, the RSA will then direct he consumer to various mattresses that are characterized by the mattress retailer as plush.

The firmness level may then be displayed in a prominent fashion adjacent to or on the respective retail mattresses, for instance, using a placard or banner or by affixing a tag to the mattress.

Once the desired firmness setting is selected, the RSA will ask the consumer to remain prone on the firmness adjustable mattress, which is at the desired firmness setting, and adjust the adjustable foundation as shown in step 108. For example, the adjustable foundation may be adjusted to lift the head region, wherein the mattress is in a non-planar configuration with respect to the lumbar and foot regions.

Referring now to step 110, the display 40 provides a contour map associated with the set firmness level at the different adjustable foundation positions, e.g., head region elevated such as may be desired when watching television, reading a book, or working in bed, for example. The contour map can be used to show a reduction in pressure points as a benefit attributed specifically to the adjustable foundation.

From this, the RSA then provides the consumer with the results, which provide the consumer with information regarding mattresses exhibiting the desired firmness level, the optimized pillows based on sleeping position, and, the benefits of the adjustable foundation. The results can be printed for the consumer or electronically stored and transmitted to the consumer, or both.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method comprising:

positioning a consumer in a retail store in a sleeping position on a planar surface of a firmness adjustable mattress operatively coupled to an adjustable foundation;

displaying to the consumer a contour map of localized pressure changes as a function of positioning the consumer on the mattress planar surface;

adjusting firmness properties of the firmness adjustable mattress to a consumer desired firmness setting and continuing the displaying of the contour map of the localized pressure changes associated with consumer desired firmness setting;

selecting a mattress with the consumer desired firmness setting based on the localized pressure changes displayed in the contour map and feedback from the consumer;

adjusting the adjustable foundation and changing the planar surface of the mattress to a non-planar surface;

continuing the displaying of the contour map to the consumer the localized pressure changes associated with the mattress non-planar surface; and recommending a combination of a mattress having the consumer desired firmness setting and the adjustable foundation to the consumer.

2. The method of claim 1, wherein the localized pressure changes associated with the mattress non-planar surface relieve pressure points relative to the contour map of the mattress planar surface.

3. The method of claim 1, wherein displaying the contour map comprises displaying the pressure changes at a 1:1 scale on an overhead display.

4. A point of sale method for a consumer to select a mattress and an adjustable foundation combination comprising:

positioning a consumer in a retail store in a sleeping position on a firmness adjustable mattress operatively coupled to an adjustable foundation, wherein the firmness adjustable mattress is at a first firmness level setting and has a planar surface;

displaying to the consumer a first contour map of localized pressure changes as a function of positioning the consumer on the firmness adjustable mattress;

eliciting a first feedback from the consumer regarding comfort level associated with the first firmness level setting;

changing the firmness adjustable mattress to at least one additional firmness level setting based on feedback from the consumer and displaying to the consumer at least one additional contour map of localized pressure changes associated with the at least one additional firmness level setting while the consumer remains on the firmness adjustable mattress;

eliciting a second feedback from the consumer regarding the comfort level of the at least one additional firmness level setting, wherein the consumer selects the first firmness level setting or the at least one additional firmness level setting as a most preferred firmness level setting;

maintaining the most preferred firmness level setting and adjusting the adjustable foundation to provide the firmness adjustable mattress with a non-planar surface;

displaying a contour map of localized pressure changes with reduced pressure points associated with the non-planar surface to the consumer relative to the contour map associated with the mattress having the most preferred firmness level;

correlating the most preferred firmness level setting to a non-adjustable mattress having the most preferred firmness level setting; and recommending a combination of a non-adjustable mattress having the most preferred firmness level and the adjustable foundation to the consumer.

5. The method of claim 4, wherein the first firmness level and the at least one additional firmness level setting are representative of at least one of soft, plush, firm, extra-firm, and ultra-firm.

6. The method of claim 4, wherein the sleeping position is a back lying position, a stomach lying position or a side lying position of the consumer.

7. The method of claim 4, wherein the display is overhead and at a 1:1 scale.

8. The method of claim 4, wherein changing the firmness adjustable mattress to the at least one additional firmness level setting comprises changing an indicator operatively coupled to the firmness adjustable mattress to a position correlating the at least one additional firmness level to at least one of soft, plush, firm, extra-firm, or ultra-firm.

9. The method of claim 4, further comprising selecting a mattress type prior to positioning the consumer.

10. The method of claim 9, wherein the mattress type is selected from the group consisting of spring coils, foam, air-filled bladders, and combinations thereof.

11. The method of claim 4, further comprising selecting a mattress type after determining the most preferred firmness level setting.

12. The method of claim 4, wherein the firmness adjustable mattress comprises a mattress core including one or more fluid filled bladders.

13. The method of claim 4, further comprising providing a pillow optimized for the sleeping position prior to positioning.

* * * * *